US006723890B2

(12) United States Patent
Tucker et al.

(10) Patent No.: US 6,723,890 B2
(45) **Date of Patent: *Apr. 20, 2004**

(54) CONCENTRATED FORMULATIONS AND METHODS FOR NEUTRALIZING CHEMICAL AND BIOLOGICAL TOXANTS

(75) Inventors: Mark D. Tucker, Albuquerque, NM (US); Rita G. Betty, Rio Rancho, NM (US); Maher E. Tadros, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 45 days.

This patent is subject to a terminal disclaimer.

(21) Appl. No.: 09/952,940

(22) Filed: Sep. 14, 2001

(65) Prior Publication Data

US 2003/0060517 A1 Mar. 27, 2003

Related U.S. Application Data

(63) Continuation-in-part of application No. 09/607,586, filed on Jun. 6, 2000, now Pat. No. 6,566,574, which is a continuation-in-part of application No. 09/109,235, filed on Jun. 30, 1998, now abandoned.

(60) Provisional application No. 60/146,432, filed on Jul. 29, 1999.

(51) Int. Cl.[7] ..... A62D 3/00; B01F 17/18; B01F 17/38; C11D 1/62; C11D 3/39

(52) U.S. Cl. ..... 588/200; 252/186.41; 510/110; 510/370; 510/372; 510/504; 516/15; 588/218; 588/221; 588/901

(58) Field of Search ..... 516/15; 252/186.41; 510/110, 370, 372, 504; 588/200, 218, 221, 901

(56) References Cited

U.S. PATENT DOCUMENTS

| | | | | |
|---|---|---|---|---|
| 4,850,729 | A | 7/1989 | Kramer et al. | 514/643 |
| 5,078,896 | A | 1/1992 | Rorig et al. | 510/372 |
| 5,421,906 | A | 6/1995 | Borah | 510/370 X |
| 5,760,089 | A | 6/1998 | Cronce | 514/643 |
| 6,015,832 | A | 1/2000 | Baker, Jr. et al. | 514/546 |
| 6,245,957 | B1 | 6/2001 | Wagner et al. | 588/200 |
| 6,525,237 | B1 | 2/2003 | Chenier et al. | 588/200 |
| 6,530,384 | B1 * | 3/2003 | Meyers et al. | 510/504 X |
| 6,566,574 | B1 * | 5/2003 | Tadros et al. | 588/200 |

FOREIGN PATENT DOCUMENTS

| | | |
|---|---|---|
| JP | 62-155203 | 10/1987 |
| WO | WO98/04668 * | 2/1998 |

OTHER PUBLICATIONS

Tadros, M., et al., "Foam for Mitigation and Decontamination of CBW Agents", 1998 DOE Chemical & Biological Nonproliferation Program Summer Meeting, Mitretek, Inc, Main Auditorium, McLean, VA, Jul. 28–30, 1998.

Hoffmann, J., et al., "Bleaching Activators as Acylating Agents: Kinetics of the Acetylation of Piperidine by Some Bleaching Activators", *Journal f. prakt. Chemie*. vol. 332, No. 2, pp. 176–180 (1990).

Raber, et al., "Oxidizers: The Solution for Chemical Agent Decontamination", 1998 DOE Chemical & Biological Nonproliferation Program Summer Meeting, Mitretek, Inc, Main Auditorium, McLean, VA, Jul. 28–30, 1998.

James, A.P., et al., "Chemistry of Peroxygen Bleaching," *Chemistry & Industry*, pp. 641–645 (Oct 15, 1990).

Mlochowski, J. and Said, S.B., "Catalyzed Hydrogen Peroxide Oxidation of Organic Compounds," *Polish J. Chem.*, vol. 71, pp. 149–169 (1997).

Tucker, M., et al., "Aqueous Foam for Mitigation and Decontamination," Chemical and Nonproliferation Program, FY 99 Annual Report, Washington DC DOE/NN–0012 (2000).

Sagripant, J–L, et al., "Comparative Sporicidal Effects of Liquid Chemical Agents," *Applied and Environmental Microbiology*, pp. 545–551, (Feb. 1996).

Drago, et al., "Catalytic Activation of Hydrogen Peroxide—A Green Oxidant System," *Proc. 1997 ERDEC Scientific Conference on Chemical and Biological Defense Research*, pp. 341–342 (Nov. 18–21, 1997).

Wagner, G.W., et al., "Baking Soda, Hydrogen Peroxide, Alcohol, The Refreshing, Universal Decon for VX, GB and HD," *Proc. 1998 ERDEC Scientific Conference on Chemical and Biological Defense Research*, pp. 285–291 (Nov. 17–20, 1998).

Tadros, M.E., et al., "Enhanced Hydrolyses of Diphynyl Chlorophosphate and Agent GD by Tetrapentyl Ammonium Bromide," *Proc. 1986 ERDEC Scientific Conference on Chemical and Biological Defense Research*, (Nov. 1986).

* cited by examiner

*Primary Examiner*—Richard D. Lovering
(74) *Attorney, Agent, or Firm*—Robert D. Watson

(57) ABSTRACT

A formulation and method of making and using that neutralizes the adverse health effects of both chemical and biological toxants, especially chemical warfare (CW) and biological warfare (BW) agents. The aqueous formulation is non-toxic and non-corrosive and can be delivered as a long-lasting foam, spray, or fog. The formulation includes solubilizing compounds that serve to effectively render the CW or BW toxant susceptible to attack, so that a nucleophillic agent can attack the compound via a hydrolysis or oxidation reaction. The formulation can kill up to 99.99999% of bacterial spores within one hour of exposure.

111 Claims, 2 Drawing Sheets

CONCENTRATED FORMULATIONS AND METHODS FOR NEUTRALIZING CHEMICAL AND BIOLOGICAL TOXANTS

CROSS REFERENCE TO RELATED APPLICATIONS

This application is a continuation-in-part application of U.S. patent application Ser. No. 09/607,586 filed Jun. 6, 2000, now U.S. Pat. No. 6,566,574, which is a continuation-in-part of U.S. patent application Ser. No. 09/109,235 filed Jun. 30, 1998 (now abandoned) and to Provisional Application Serial No. 60/146,432 filed Jul. 29, 1999, wherein the specifications of all three applications listed above are herein incorporated by reference.

FEDERALLY SPONSORED RESEARCH

The United States Government has rights in this invention pursuant to Department of Energy Contract No. DE-AC04-94AL85000 with Sandia Corporation.

BACKGROUND OF THE INVENTION

The present invention is directed to materials and methods for neutralization and decontamination of chemical and biological toxants. In particular, the present invention is directed to concentrated formulations containing solubilizing compounds and reactive compounds that can be rehydrated with water and then delivered as foams, sprays, liquids, fogs and aerosols to contaminated surfaces.

Terrorist threats, potentially involving weapons of mass destruction, are increasing both in the United States and abroad. The use, and threat of use, of chemical warfare (CW) and biological warfare (BW) agents in the context of weapons of mass destruction are of paramount concern both to national defense as well as to state and local law enforcement.

Certain CW agents known to pose a threat by terrorists share chemical characteristics that present an opportunity for the development of countermeasures. The chemical agents sarin, soman, and tabun (G-agents) are all examples of phosphorus-containing compounds which, when altered chemically, can lose their toxicity. Mustard, which is an example of the H-agents, and VX, which is an example of the V-agents, can also be altered chemically and rendered harmless. In addition, certain of the known BW agents, including botulinum toxin, anthrax and other spore-forming bacteria, vegetative bacteria, including plague, and various viruses can also be deactivated chemically.

An effective, rapid, and safe (non-toxic and non-corrosive) decontamination technology is required for the restoration of civilian facilities in the event of a domestic terrorist attack. Ideally, this technology should be applicable to a variety of scenarios such as the decontamination of open, semi-enclosed, and enclosed facilities as well as sensitive equipment. Examples of types of facilities where the decontamination formulation may be utilized include a stadium (open), an underground subway station (semi-enclosed), and an airport terminal or office building (enclosed). Many industrial applications have needs for an environmentally benign decontamination solution, including food processing plants, animal farms, hospitals, nursing homes, ambulances, etc.

The compounds that have been developed for use in detoxification of both CW and BW agents have been deployed in a variety of ways, including liquids, foams, fogs, gels, pastes, creams, and lotions. Stable aqueous foams (including "sticky" foams with glue added) have been used in various applications including fire fighting and law enforcement applications (such as prison riot containment). Such foams, however, have typically been made using anionic surfactants and anionic or nonionic polymers. These foams, unfortunately, have not been effective in the chemical decomposition and neutralization of most chemical and biological weapons (CBW) agents.

A new class of aqueous-based decontamination formulations, designated generically as "DF-100", and a method for manufacturing DF-100, was disclosed in commonly-assigned U.S. patent application Ser. No. 09/607,586, "Formulations for Neutralization of Chemical and Biological Toxants" by Tucker and Tadros, filed Nov. 1, 2000, which is herein Incorporated by Reference. Hereinafter, that application will be referred to as the '586 application. The formulations for DF-100 have been proven effective for neutralizing both chemical and biological agents, is environmentally benign (non-toxic and non-corrosive), works on a variety of anticipated surfaces, can be rapidly deployed, requires minimal logistics support, is relatively inexpensive, and can be incorporated into a wide variety of carriers (e.g., foams, liquid sprays, fogs, mists, and aerosols).

The formulations for DF-100 comprise a cationic surfactant and a reactive compound; that when mixed with a carrier (such as water or seawater in a fluid phase) and exposed to a toxant, neutralizes the toxant. The reactive compound can be a nucleophilic or oxidizing compound or a mixture of both. Hence, the reactive compound can be both oxidizing and nucleophillic. The reactive compound can be selected from hydrogen peroxide, urea hydrogen peroxide, an activated peroxide compound (e.g., hydrogen peroxide+bicarbonate) hydroperoxycarbonate, oximates, alkoxides, aryloxides, aldehydes, peroxymonosulfate, Fenton's reagent, and sodium hypochlorite. The cationic surfactant solubilizes the sparingly soluble toxants.

A cationic hydrotrope (an ionic-surfactant-like material with short hydrocarbon segments) can be added, which increases the solubility of the toxant in aqueous media, increases subsequent reaction rates between the reactive compound and the toxant, and significantly increases the physical stability of foams made with DF-100. Increasing the foam's stability and liquid-holding power improves the overall effectiveness of neutralization of toxants by increasing the contact time of the decontamination solution with the toxant.

The formulations of DF-100 exploit the principles of cationic micelle catalysis and the solubilization power of cationic hydrotropes to dissolve the otherwise sparingly soluble toxants.

The principle for detoxifying chemical agents in the foam is to provide a mechanism to solubilize the sparingly soluble chemical (CW) agents, and to attract a nucleophilic agent, dissolved in aqueous media, to a position in close proximity to the agent molecule vulnerable to nucleophilic attack. This is accomplished through the recognition that certain nucleophilic agents are negatively charged. Therefore, the DF-100 solution contains cationic surfactants that form positively-charged micelles, which solubilize the CW agents and attract the negatively-charged nucleophiles, such as hydroxyl ions ($OH^-$), hydroperoxide ions ($OOH^-$), and hydroperoxycarbonate ions ($HCO_4^-$). The negatively-charged nucleophiles are formed from the addition of hydrogen peroxide to the DF-100 solution, or by reacting hydrogen peroxide with a bicarbonate salt to form the highly-reactive hydroperoxycarbonate species (a much stronger oxidant).

In the aqueous environment, the CW agent is located (i.e., solubilized) within the micelle comprises of an aggregate of surfactant molecules with hydrophobic tails forming the interior core of the micelle, and hydrophilic heads concentrating at the outer surface of the micelle. These positively-charged hydrophilic heads attract the negatively-charged nucleophiles, greatly enhancing the reaction rates with the CW agents within the micelle. In this sense, the cationic surfactant acts as a catalyst to speed up the reaction between the toxant and the reactive compound. This is contrasted with the situation that would occur in a foam constructed with anionic surfactants, such as typical firefighting foam, where the negatively-charged micelles would repel the negatively-charged nucleophiles and reduce the reaction rate.

The DF-100 formulation can also contain hydrotropes, which are ionic surfactant-like molecules with short hydrocarbon segments that are added to increase the solubility of the surfactants and the CW agents. To ensure chemical compatibility, cationic hydrotropes are used. The cationic hydrotropes also contribute by significantly increasing the rate of hydrolysis of CW agents.

With respect to neutralization of BW agents, the solubilizing compounds serves to solubilize and soften the biological agent's outer coat, thereby exposing the biological agent's DNA to the reactive compound. After the solubilizing compound enhances exposure of the toxant to the reactive compound, the reactive compound reacts with the toxant, either by an oxidation or hydrolysis reaction, to neutralize the toxant. For biological agents, the solubilizing compound can be a cationic surfactant, an alcohol such as a fatty alcohol, or a cationic hydrotrope.

Depending upon the concentration of the various compounds used in the formulation of DF-100, greater than 99.999% and often as much as 99.99999% (7-log kill) or more of biological toxants (including anthrax spores) can be neutralized (killed) within approximately one hour.

The DF-100 formulation can also include a bicarbonate salt (e.g., potassium, sodium, or ammonium bicarbonate). Then, if hydrogen peroxide is used as the reactive compound, the peroxide can react with the bicarbonate to form a highly reactive hydroperoxycarbonate species, which is especially effective in reacting with biological toxants to neutralize them.

The DF-100 formulation can be adjusted to optimize its ability to be deployed successfully as a foam by adding water soluble cationic polymers and/or long-chain fatty alcohols. Polymer additions increase the solution's viscosity. Long chain fatty alcohols increase the stability of the foam against excessive liquid drainage and/or bubble collapse.

Short-chain alcohols can also be added to DF-100 to aid in solubilization, and glycol ether can be added to solubilize the fatty alcohols.

DF-100 formulations are typically "activated" by adding the reactive compound as the last step, after all of the other components have been mixed together, immediately prior to use. However, the neutralization effectiveness of activated DF-100 solution degrades rapidly with time (after only 8 hours). Hence, the pot life of an activated DF-100 solution is somewhat limited. Therefore, to extend the shelf life, DF-100 can be manufactured as a two-part, binary system (i.e., in kit form), comprising a relatively inert component (Part A) and an active ingredient (Part B) comprising the reactive compound. Part B is then added to Part A immediately prior to use, thereby maximizing the effectiveness of the activated formulation.

In a binary system, Part A comprises the relatively inert ingredients of DF-100, and, hence, has a relatively long shelf life. However, the reactive ingredients used for Part B, such as an aqueous solution of hydrogen peroxide, generally have a much shorter shelf life (hydrogen peroxide natural decomposes into water and oxygen). Storage of DF-100 as a binary system thereby usefully enables the shorter shelf life component (Part B) to be replaced more frequently, and with a lower cost than replacing the entire (i.e., activated) formulation (A+B).

The '586 application discloses a variety of methods for manufacturing the DF-100 formulations as a binary system. In one method, hereinafter referred to as the '586 method, the relatively inert component, Part A, is produced in a form where nearly all of the water necessary to make-up the activated DF-100 solution (A+B) has already been added to Part A during the manufacturing process. Part A subsequently has a concentration (wt %) of 87%–92%. Part A has a relatively long shelf life, and is ready for shipping and use in the field. Then, in the field, the final ingredient (reactive component Part B) is added and mixed to produce an activated DF-100 solution having a final hydrogen peroxide concentration of 0.1–4%. In the '586 method, Part B comprises a highly concentrated, aqueous solution (30%–50%) of hydrogen peroxide. This '586 method is schematically illustrated in FIG. 1, where 920 ml of 92% "concentrate" (Part A) is mixed with 80 ml of 50% hydrogen peroxide solution (Part B) to produce 1000 ml of activated DF-100 foam solution (i.e., ready-to-use foam solution) having an ultimate hydrogen peroxide concentration of 4%.

Example 1 lists the ingredients of Part A that can be used with the '586 method for making a DF-100 foam formulation.

EXAMPLE 1

Ingredients of Part A that Can be Used with the '586 Method

- 18 L of deionized water (carrier)
- 691.2 g of WITCO ADOGEN 477™ (cationic hydrotrope)
- 360 g of Alcohol Mix #1
- 36 g of JAGUAR 8000™ (cationic water-soluble polymer)
- 10% HCL, a few ml's, (used to adjust the pH to 6.5)
- 540 g of WITCO VARIQUAT 80MC™ (cationic surfactant)
- 270 g of Alcohol Mix #2 (foam stabilizer)
- 900 g of potassium bicarbonate (for later reacting with $H_2O_2$ in Part B)

WITCO VARIQUAT 80MC™ (cationic surfactant) is a trademarked mixture of benzyl (C12–C16) alkyldimethylammonium chlorides. WITCO ADOGEN 477™ (cationic hydrotrope) is a trademarked pentamethyltallow alkyltrimethylenediammonium dichloride. JAGUAR 8000™ (cationic water-soluble polymer) is a trademarked Guar Gum, 2-hydroxypropyl ether. Alcohol Mix #1 comprises a mixture of 36.4% isobutanol, 56.4% diethyleneglycol monobutylether (DEGMBE), and 7.3% dodecanol. Alcohol Mix #2 comprises a 1:1 (wt %) mixture of dodecanol and DEGMBE. The composition of Part A prepared according to Table 1 produces 20.7 liters of Part A having a concentration of 92%.

Example 2 illustrates an example of a procedure for preparing Part A from the ingredients listed in Example 1.

EXAMPLE 2

Procedure for Preparing Part A from the Ingredients in Example 1

1. Pour 18 L of deionized $H_2O$ into large carboy with largest stir bar available.
2. Add 691.2 g of WITCO ADOGEN 477™ (cationic hydrotrope). Rinse beaker used to weigh 477 w/ $H_2O$ from carboy, adding rinses back to the carboy.
3. Add 360 g of Alcohol Mix #1 (36.4% isobutanol; 56.4% DEGMBE; 7.3% dodecanol). Note the pH and continue to measure pH throughout the procedure.
4. Add 36 g of JAGUAR 8000™ (water-soluble polymer). Add the JAGUAR 8000™ slowly to avoid lump formation; tap in slowly from spatula. After finished adding the entire JAGUAR 8000™, stir for 15 minutes. The pH should rise as the JAGUAR dissolves. Note: This is a polymer used to slightly increase the viscosity of the water, producing a more stable foam.
5. Slowly adjust the pH of the solution with drop by drop addition of 10% HCl. Adjust to pH=6.5; this only takes a few ml's. Stir for 1 hour. The pH is lowered to solubilize the polymer. 10% HCl: 53.5 ml HCl (37.4%)+146.5 ml $dH_2O$.
6. Add 540 g of WITCO VARIQUAT 80MC™ (cationic surfactant), slowly. Note the pH (it will rise). Rinse the beaker used to weigh the VARIQUAT w/ solution from the carboy, adding rinses back to the carboy. Remove the pH probe and cover the carboy. Stir for 2 hours.
7. Add 270 g of Alcohol Mix #2, 1:1 (wt. %) dodecanol and DEGMBE, diethyleneglycol monobutylether. Add dropwise over a 1-hour period. Stir for 1 additional hour. Note final pH of foam. DEGMBE is used as a solvent for the dodecanol. Dodecanol is used to increase the surface tension w/in the laminar wall bilayer of the foam. Increased surface tension provides greater foam stability because the liquid layer between the laminar walls will not drain as fast.
8. Add 900 g of potassium bicarbonate and mix well to dissolve.

Part A can then be transported to the field, where it can be mixed with a sufficient amount of highly concentrated (30%–50%) hydrogen peroxide solution, Part B, to produce an activated DF-100 foam solution having an ultimate hydrogen peroxide concentration of 4%; made, for example, by mixing 1.8 liters of a 50% hydrogen peroxide solution (Part B) with the 20.7 liters of Part A made according to Example 2 to produce 22.5 liters of activated DF-100 foam solution.

Table 1 lists the constituents and concentrations of the activated DF-100 foam solution, made, for example, by mixing Part A from Example 1 with a sufficient amount of Part B (30–50% hydrogen peroxide solution).

TABLE 1

Activated DF-100 Foam Solution #1

| CONSTITUENT | CONCENTRATION (wt. % of overall formulation) |
|---|---|
| Cationic Surfactant | 2.6% |
| Cationic Hydrotrope | 3.3% |
| Water Soluble Polymer | 0.1% |
| Fatty Alcohol | 0.8% |
| Short Chain Alcohols | 2.1% |
| Glycol Ether (DGEMBE) | 1.6% |

TABLE 1-continued

Activated DF-100 Foam Solution #1

| CONSTITUENT | CONCENTRATION (wt. % of overall formulation) |
|---|---|
| Bicarbonate | 4.0% |
| Hydrogen Peroxide | 4.0% |
| Water | Balance |

The cationic surfactant can be a quaternary ammonium salt, such as cetyltrimethyl ammonium bromide. Other examples of cationic surfactants include polymeric quaternary compounds. The concentration of the quaternary ammonium salt is restricted to be no more than 10 wt % because at higher concentrations the quaternary ammonium salt becomes significantly toxic to humans and to the environment. Examples of suitable cationic hydrotropes are tetrapentyl ammonium bromide, triacetyl methyl ammonium bromide, and tetrabutyl ammonium bromide. The fatty alcohols may contain 10–16 carbon atoms (e.g., 1-dodecanol or 1-tetradecanol). The combination of bicarbonate and hydrogen peroxide forms a highly effective oxidizer (the highly reactive hydroperoxycarbonate species), which is a significant contributor to the neutralization of CBW agents. The concentration of hydrogen peroxide is restricted to no more than 10% (e.g. 4%), because higher concentrations are significantly corrosive, especially in the range of 30–50% concentration. The weight percentage ratio of surfactant to hydrotrope in Foam Solution #1 is equal to 0.8 (i.e., 2.6% divided by 3.3% equals 0.8).

Making up activated DF-100 solution using the '586 method requires that a highly concentrated (30%–50%), highly toxic, and highly corrosive aqueous solution of hydrogen peroxide (Part B) be stored, transported, and handled.

However, if the concentration of the aqueous hydrogen peroxide solution (Part B) could be reduced to less than 8% (e.g., by diluting it with water), then it could be stored, shipped, and handled as a "non-hazardous" material, without the concurrent safety and health concerns. Alternatively, Part B could be stored in a dry solid or powder form, such as urea hydrogen peroxide, and then added to a sufficient amount of water to make a safe, diluted solution of hydrogen peroxide having a concentration less than 8%. Note that the step of adding the urea hydrogen peroxide powder to water to make up Part B could also be done in the field, prior to mixing Parts A and B.

Concurrently, if the concentration of Part A could be changed from 92% (essentially unconcentrated) to about 14–25% (highly concentrated), then the size, weight, and cost of the containers used for manufacturing, and the costs for shipping, and storing the concentrate (Part A) could be significantly reduced.

Against this background, the present invention was developed.

SUMMARY OF THE INVENTION

Figure 1:
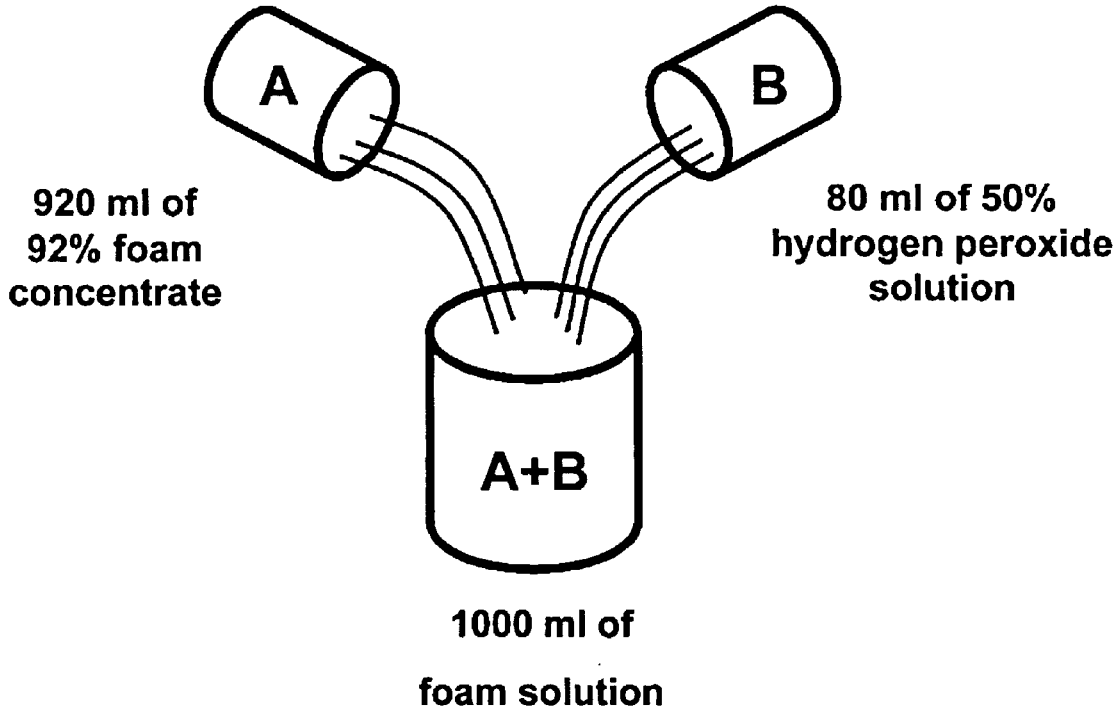
FIG. 1 illustrates a procedure for mixing 920 ml of Part A (92% concentration) with 80 ml of Part B (50% concentration of hydrogen peroxide) to form 1000 ml of activated DF-100 foam solution.

A formulation and method of making and using that neutralizes the adverse health effects of both chemical and biological toxants, especially chemical warfare (CW) and biological warfare (BW) agents. The aqueous formulation is non-toxic and non-corrosive and can be delivered as a long-lasting foam, spray, or fog. The formulation includes solubilizing compounds that serve to effectively render the CW or BW toxant susceptible to attack, so that a nucleophillic agent can attack the compound via a hydrolysis or oxidation reaction. The formulation can kill up to 99.99999% of bacterial spores within one hour of exposure.

DETAILED DESCRIPTION OF THE INVENTION

The present invention relates to a highly concentrated binary or ternary system that, when mixed to form an activated decontamination formulation (DF-100) and deployed in the field, neutralizes the adverse effects of chemical and/or biological toxants. Here, a toxant is defined as any chemical or biological compound, constituent, species, or agent that through its chemical or biological action on life processes can, if left untreated, cause death, temporary incapacitation, or permanent harm to humans or animals. This includes all such chemicals or biological agents, regardless of their origin or of their method of production, and regardless of whether they are produced in facilities, in munitions, weapons, or elsewhere. The present invention is also useful for disinfection and sterilization for medical, hospital, ambulance, institutional, educational, agricultural, food processing, and industrial applications.

Neutralization is defined as the mitigation, de-toxification, decontamination, disinfection, sterilization or otherwise destruction of toxants located on a surface, to the extent that the toxants no longer cause acute adverse effects to humans or animals. The word "formulation" is defined as the activated product or solution that is actually applied to a surface for the purpose of neutralization, with or without the addition of air to create a foam.

Unless otherwise specifically stated, the concentrations of constituents or components listed herein are relative to the weight percentage of the overall formulation (i.e., the activated DF-100 solution).

Table 2 provides a list of components and ranges of concentrations in an embodiment of an activated DF-100 foam solution that has been shown to effectively neutralize toxants, both chemical and biological, where water is used as the carrier.

TABLE 2

Activated DF-100 Foam Solution #2

| CONSTITUENT | RANGE OF CONCENTRATION (wt. % of overall formulation) |
|---|---|
| Cationic Surfactant | 0.1–10% |
| Cationic Hydrotrope | 0.1–10% |
| Water Soluble Polymer | 0.05–10% |
| Fatty Alcohol | 0.1–2% |
| Reactive Component | 0.1–10% |
| Water | Balance |

Table 3 provides a list of components and concentrations in another embodiment of an activated DF-100 foam solution that has been shown to effectively neutralize toxants, both chemical and biological, where water is used as the carrier.

TABLE 3

Activated DF-100 Foam Solution #3

| | |
|---|---|
| 4.2% | WITCO VARIQUAT 80MC ™ (cationic surfactant) |
| 1.4% | WITCO ADOGEN 477 ™ (cationic hydrotrope) |
| 0.07% | JAGUAR 8000 ™ (cationic water soluble polymer) |
| 1.3% | 1-Dodecanol (fatty alcohol) |
| 0.5% | 1-Tetradecanol (fatty alcohol) |
| 0.4% | Isobutanol (short chain alcohol) |
| 0.8% | Isopropanol (short chain alcohol) |
| 1.5% | Diethylene Glycol Monobutyl Ether (glycol) |
| 4.0% | Potassium Bicarbonate (reacts with $H_2O_2$) |
| 4.0% | Hydrogen Peroxide (reactive compound) |
| Balance | Water (carrier) |

TABLE 4

Activated DF-100 Foam Solution #4

| | |
|---|---|
| 5.3% | WITCO VARIQUAT 80MC ™ (cationic surfactant) |
| 2.8% | WITCO ADOGEN 477 ™ (cationic hydrotrope) |
| 0.1% | JAGUAR 8000 ™ (cationic water soluble polymer) |
| 0.7% | 1-Dodecanol (fatty alcohol) |
| 0.5% | Isobutanol (short chain alcohol) |
| 1.4% | Diethylene Glycol Monobutyl Ether (glycol) |
| 4.0% | Potassium Bicarbonate (reacts with $H_2O_2$) |
| 4.0% | Hydrogen Peroxide (reactive compound) |
| Balance | Water (carrier) |

The activated DF-100 foam solutions #3 and #4 contains slight modifications (compared to Formulation #1) that were made for the purpose of increasing the effectiveness of decontamination at a single pH value, and for improving the foam's stability. In particular, the concentration of cationic surfactant was increased, the concentration of cationic hydrotrope was decreased, and the concentration of short chain alcohol was decreased. In Solution #3, the weight percentage ratio of surfactant to hydrotrope is equal to 3, while the ratio in Solution #4 is 1.9. Both of these weight percentage ratios are significantly higher than in the original formulation (Solution #1), where the weight percentage ratio was less than 1 (i.e., 0.8).

Delivery of Activated DF-100 as a Foam

The formulations of the present invention can be delivered and applied to the toxants in a variety of manners and phases to provide the necessary detoxification and decontamination. One useful form of delivery is as a foam.

Most foams are stored and deployed as concentrates, with water being added in the field. Typical fire fighting foams are available in concentrates ranging from 0.1% to 6%. In other words, for a 0.1% concentrate, every 100 gallons of ready-to-use foam solution is made up of 0.1 gallons of the concentrate and 99.9 gallons of water. Likewise, for a 6% concentrate, every 100 gallons of foam solution is made up of 6 gallons of the concentrate solution and 94 gallons of water.

Useful attributes of the foam, as they relate to the present invention, are that the formulation has medium to high expansion ratios and is highly stable. The expansion ratio of a foam is defined as the ratio between the volume of foam produced and the original liquid volume. This property is important because higher expansion ratios allow less water usage during a decontamination event. However, if the expansion ratio is too high, there may not be enough water in the formulation for effective decontamination. In addition, at high expansion ratios (greater than about 60) it is difficult to produce a stream of foam that can be directed to various locations (i.e., the foam simply falls straight down as it leaves the foam generating nozzle). However, foam with high expansion ratios (approximately 80–120) is extremely effective for filling volumes of space and for blanketing large surface areas. On the other hand, foam with medium expansion ratios (approximately 20–60) is very effective for shooting at specific targets and for sticking to vertical surfaces and the underside of horizontal surfaces. The activated DF-100 foam solution of the present invention can be used to generate a foam with a medium expansion ratio and with a high expansion ratio in an aspirating air foam generating system by simply selecting the appropriate foam generating nozzle and controlling the bulk viscosity of the formulation. The bulk viscosity of the formulation determines its degree of spreading as it leaves the foam nozzle that allows the liquid to strike the cone of the nozzle in the appropriate location to generate a foam. All foam nozzles are designed for use with liquid formulations in specific bulk viscosity ranges. The water-soluble polymer can be added at a sufficient concentration to give a bulk viscosity in the range of that required for the specific foam generating nozzles that were used. In a compressed gas foam generating system, the expansion ratio is governed by changing the volume of gas injected into the liquid stream. The gas can be air, nitrogen, or carbon dioxide, for example.

The foam solution can be educted (sucked up) from a container holding concentrated formulation and mixing the educted concentrate with a stream of water.

An important property of a foam is its physical stability. Foam stability is measured by its half-drainage time, which is defined as the time required for a foam to lose half of its original liquid volume. For example, if one liter of solution is used to generate a foam, the half-drainage time is defined as the amount of time for 500 ml of solution to drain from the foam. This property is important because a stable foam allows a greater contact time between the formulation and the chemical or biological agent. Foam stability is achieved by increasing the time required for liquid to drain from the film. Increasing the surface viscosity of the liquid can control liquid drainage from the film. The higher the surface viscosity, the more stable the foam. Fatty alcohols can be added to increase the surface viscosity because of the highly efficient molecular packing between the fatty alcohol and surfactant molecules at the surface. This increases the resistance to flow in the liquid film, which creates a more stable foam bubble. The activated DF-100 foam solutions of the present invention produces a foam with half-drainage times of several hours.

The foam can be deployed in a variety of devices, depending on the volume of foam that is desired. Successful deployment has occurred using small hand-held devices that are similar to fire extinguishers, and in large-scale foam generating devices.

The DF-100 foam formulations of the present invention have been successfully deployed by small fire extinguisher-type units pressurized by $CO_2$ cartridges, by hand-held units which are pressurized by a connection to a fire hydrant, and by large military-style pumps. Each of these foam-generating units uses a foam nozzle that draws air into the foam through a Venturi effect. There is no need to supply air to the foam nozzle; the foam is generated through the use of room air. This is important because a supplied-air foam generator will add air to the room where foam is being produced, pushing the existing air away (outside of the room) and causing the migration of chemical and biological agents. The foam has also been successfully generated through compressed air foam systems. In these systems, air is directly injected into the liquid stream before the liquid leaves the foam nozzle.

DF-100 can be produced as a "sticky foam", where glue-like additives have been used to increase the adhesive power of the foam.

Another important issue concerning foam deployment is cleanup of the foam after it has been generated and has achieved decontamination of the CW and BW agents. Although the foam is highly stable, it can be broken down very easily with the use of commercially available de-foamers. After deployment of the foam and a sufficient period of time for decontamination of the agents, the foam can be removed with a water spray containing a low concentration (1–2%) of the de-foamer. This process returns the foam to a liquid state.

Using these devices, successful decontamination using DF-100 foam formulations of both CW and BW agents and simulants has been demonstrated. For CW work, live agent testing has been conducted with GD (Soman), VX, and HD (Mustard). The half-lives for the decontamination of these agents in the foam system is on the order of 2 minutes to 20 minutes. Addressing BW agents, 7-log kill (99.99999%) of anthrax spores has been achieved after approximately a one-hour exposure to the foam. Other BW work has demonstrated rapid kill of the simulants for plague (a vegetative bacterial cell) and for the smallpox virus.

Non-foaming Delivery of Activated DF-100 Solution

Alternative non-foaming methods exist for deploying activated DF-100 foam and non-foaming solutions, including spraying, fogging, misting, exposure to aerosols, wiping with a wet or saturated cloth or towlette for personal skin decontamination; drenching, immersing, spraying with a hand-held spray bottle or backpack-mounted spray apparatus, showering, spraying with a curtain spray, pouring, dripping, and bathing in the liquid formulation. Additionally, DF-100 solutions can be deployed in a semi-solid carrier, such as in gels, lotions, creams, and pastes. Deployment can be done by people, deployed from aircraft, helicopters, trucks, tanks, railroad, boats, bicycle, or by automated systems, including mobile robots.

Deployment can include mixing together all of the components of a multi-part kit system immediately prior to application. Deployment can include using an eductor apparatus to induct one or more of the components into one or more streams of moving water. Deployment can include mixing together a two-part binary system, comprising adding a sufficient amount of water to a packet containing urea hydrogen peroxide to make up a solution of hydrogen peroxide, and then applying the solution of hydrogen peroxide to a premoistened towlette comprising all of the other constituents of the decontamination formulation except for hydrogen peroxide to activate the towlette.

Deployment can include applying the formulation to a surface inside of an industrial setting selected from, for example, a food processing plant, a hospital, an agricultural facility, an institutional building, an ambulance, and a cooking area.

The fact that DF-100 contains one or more surfactants, means that it has enhanced capability to penetrate porous objects, due to the effect of the surfactant on reducing surface tension, increasing penetration power.

A fog (e.g., aerosols with particulate sizes ranging from 1–30 microns) can be used to achieve effective decontamination in areas where decontamination by a foam would be difficult, if not impossible. One example is the interior of air conditioning ducts. A fog can be generated at registers and other openings in the duct and travel a significant distance inside of the duct to decontaminate hard to reach places. A relatively automated fog-based decontamination system can be set-up at the scene of an attack. Remotely activated foggers can be placed inside of a facility and turned on at periodic intervals (from a remote location) to completely decontaminate the facility. This method greatly decreases the potential for decontamination personnel to be exposed to a CBW agent.

The non-foaming formulation contains similar constituents as the foam formulation. However, various constituents used for foaming have been removed.

Table 5 provides a list of components and ranges of concentrations in an embodiment of an activated DF-100 non-foaming solution that has been shown to effectively neutralize toxants, both chemical and biological, where water is used as the carrier.

TABLE 5

Activated DF-100 Non-foaming Solution #5

| CONSTITUENT | RANGE OF CONCENTRATION (wt. % of overall formulation) |
|---|---|
| One or more of a: | |
| Cationic Surfactant, or | 0.1–10% |
| Cationic Hydrotrope; | 0.1–10% |
| Hydrogen Peroxide; | 0.1–4% |
| Potassium Bicarbonate; and | 0.1–4% |
| Water. | Balance |

Table 6 provides a list of components and concentrations in another embodiment of an activated DF-100 non-foaming solution that has been shown to effectively neutralize toxants, both chemical and biological, where water is used as the carrier.

TABLE 6

Activated DF-100 Non-foaming Solution #6

| CONSTITUENT | RANGE OF CONCENTRATION (wt. % of overall formulation) |
|---|---|
| Cationic Surfactant | 0.1–10% |
| Cationic Hydrotrope | 0–10% |
| Hydrogen Peroxide | 0.1–10% |
| Bicarbonate Salt | 0.1–10% |
| Water | Balance |

Table 7 provides a list of components and concentrations in another embodiment of an activated DF-100 non-foaming solution that has been shown to effectively neutralize toxants, both chemical and biological, where water is used as the carrier.

TABLE 6

Activated DF-100 Non-foaming Solution #7

| CONSTITUENT | CONCENTRATION (wt. % of overall formulation) |
|---|---|
| Cationic Surfactant | 2.7% |
| Cationic Hydrotrope | 3.5% |
| Hydrogen Peroxide | 4% |
| Bicarbonate Salt | 4% |
| Water | Balance |

In one test to demonstrate neutralization of a chemical agent using an activated DF-100 non-foaming solution, 25 microliters (~20 mg) of a chemical agent simulant, diphenyl chloro phosphate, was placed on a test coupon (carpet, metal, wood, etc.). The coupon was placed inside of a test chamber that was then filled with the fog (non-foaming) formulation generated from a commercial fogging device (droplet sizes between 1–20 microns). The same simulant was placed on identical test coupons to serve as an experimental control. After one hour, the control and experimental test coupons were placed in a solution of acetronitrile for one hour to extract unreacted simulant. The acetonitrile solution was then analyzed by gas chromatography to determine the mass of unreacted simulant. Greater than 99% neutralization of the G agent simulant (diphenyl chloro phosphate) was achieved after one hour exposure to the fog in a test chamber on all surfaces tested and complete neutralization was achieved after four successive fog treatments (with a one hour wait between each treatment) for all surfaces. Between 1% and 30% neutralization was achieved after four successive foggings of the VX simulant (O-ethyl-S-ethyl phenyl phosphonothioate) and between 30% and 75% neutralization was achieved with the mustard simulant (chloroethyl ethylsulfide) after four successive foggings. For the anthrax simulant (*B. globigii* spores), a 7-Log kill was achieved after four successive foggings.

One difference between the present activated DF-100 non-foaming (e.g., fog) formulation over existing fogging solutions for decontamination of CBW agents is that the present invention is water-based. Current fogging solutions for CBW decontamination utilize organic liquids. The present formulation also has low toxicity and low corrosivity properties. This allows the formulation to be used where exposure to people, animals, or equipment may be necessary or prudent.

Manufacturing of DF-100 Formulations in Highly Concentrated Kit Forms

Highly concentrated DF-100 foam concentrates (14% to 30% concentration) and very highly concentrated DF-100 non-foaming concentrates (6% to 30%)have been developed as part of the present invention (i.e., for a 25% foam concentrate, 100 gallons of ready-to-use foam solution is made up of 25 gallons of the concentrate and 75 gallons of water). The foam concentrate does not include hydrogen peroxide, and may or may not include the bicarbonate salt (see discussion below). These constituents would generally be added to the rehydrated foam solution immediately before use in the field. The kits can be manufactured as either binary or ternary kit systems, depending on the degree of concentration.

The reactive compound (e.g., hydrogen peroxide), the carrier (e.g., water), and (possibly) the bicarbonate salt can be stored separately from the other compounds of the DF-100 formulation in a highly concentrated binary (or ternary) kit form prior to use. The separation of the reactive compound from the other compounds of the formulation is useful for increasing storage lifetime and stability. The reactive compound, such as hydrogen peroxide, is added to the formulation immediately before use because its reactivity, as well as the reactivity of the activated formulation, degrades over time. Note that the hydrogen peroxide can be stored in a solid form (e.g., urea hydrogen peroxide), which is considered to be relatively safe for shipping and handling. This eliminates the hazards of handling highly concentrated solutions of hydrogen peroxide (30%–50%).

Because water (or saltwater) will generally be available at or near the site where neutralization needs to occur, the compounds associated with the formulation other than water do not need to be combined immediately with water. They can be transported separately to the detoxification site and water added at that location and time. This aids in economy of transport. The formulations of the present invention are therefore suitable for use in various kit forms, including highly concentrated kit forms.

Binary Kit for Concentrated DF-100 Foam Formulation

In a two-part, binary kit for a DF-100 foam formulation, Part A comprises a relatively inert foam concentrate (including bicarbonate salt), and Part B comprises the reactive compound (e.g., hydrogen peroxide). The foam concentrate (Part A) can be manufactured and premixed in a concentrated form having a concentration from 30% to 92%. For a binary foam kit, the strongest concentration of Part A is limited to about 30% because the solubility limit for the bicarbonate salt (e.g., potassium bicarbonate) prevents a concentration stronger than about 30%. Part B can comprise a highly diluted solution (≦8%) of hydrogen peroxide, or can be a highly concentrated solution (e.g., 30–50%).

Alternatively, Part B can comprise a pre-measured packet or container of water-soluble solid form of hydrogen peroxide, such as urea hydrogen peroxide, sodium perborate, or sodium percarbonate, where the solid (e.g., powder) is added to a sufficient amount of water to make a solution of hydrogen peroxide having a concentration of hydrogen peroxide less than or equal to 34%, which is the solubility limit in water of urea hydrogen peroxide. Of these three, urea hydrogen peroxide is the most effective solid form (comprising 36% hydrogen peroxide).

Figure 2:
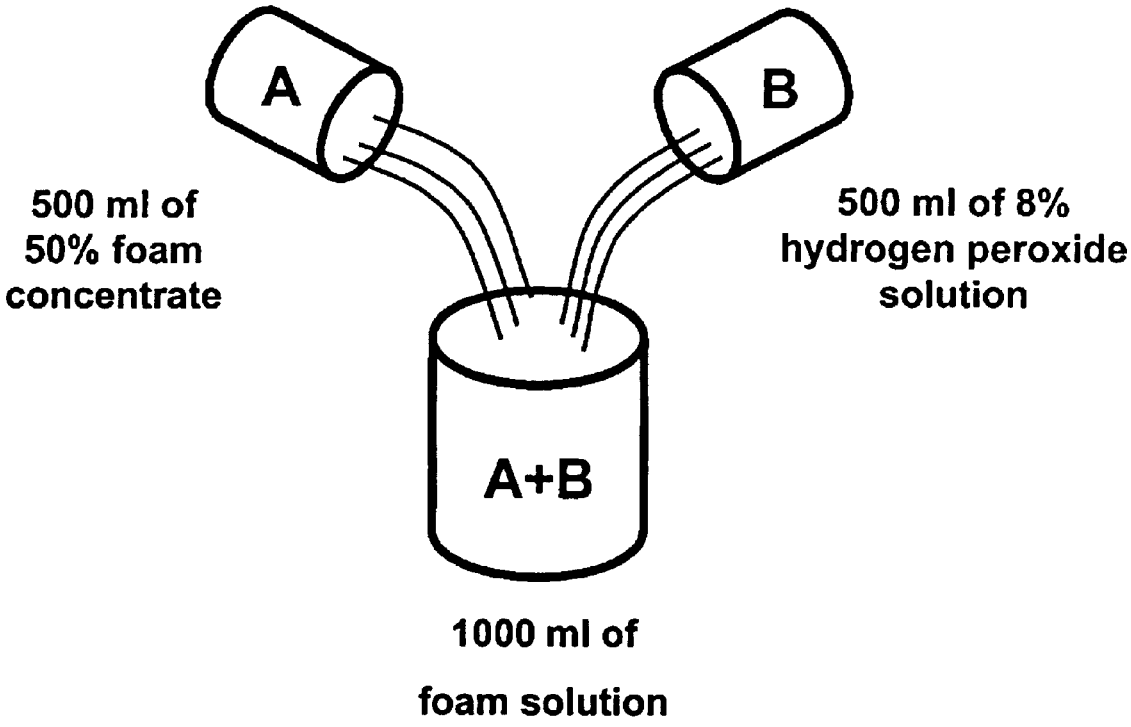
FIG. 2 illustrates a procedure for mixing 500 ml of Part A (50% concentration) with 500 ml of Part B (8% concentration of hydrogen peroxide) to form 1000 ml of activated DF-100 foam solution, according to the present invention.

FIG. 2 schematically illustrates a method for making up an activated DF-100 foam solution in the field from a concentrated binary foam kit, according to the present invention. In this example, 500 ml of a 50% foam concentrate (Part A) is mixed with 500 ml of an 8% hydrogen peroxide solution (Part B) to yield a total of 1000 ml of activated DF-100 foam solution (i.e., foam solution), having an ultimate hydrogen peroxide concentration of 4%, and which is now ready to be used in a foam-generating nozzle (Venturi or air compressor system). The ≦8% hydrogen peroxide solution (Part B) can be produced by aqueous dilution of highly concentrated liquid peroxide (e.g., 50%), or by dissolving a highly water-soluble solid form of hydrogen peroxide, such as urea hydrogen peroxide, in water. In the example of FIG. 2, the 500 ml of 8% hydrogen peroxide solution can be produced by dissolving 111 grams of urea hydrogen peroxide in 500 ml of water (urea hydrogen peroxide is 36% hydrogen peroxide).

Ternary Kit for Highly Concentrated DF-100 Foam Formulation

The foam concentrate (Part A) can be manufactured and premixed in a highly concentrated form having a concentration in the range of about 14–30%. However, in this case, the bicarbonate salt (e.g., potassium bicarbonate) cannot be added directly to Part A because of the limits on the bicarbonate's solubility at this high concentrations. Consequently, a three-part, ternary kit can be used that comprises:

| | |
|---|---|
| Part A | Foam Concentrate (14–30%), without bicarbonate |
| Part B | Hydrogen Peroxide Solution (8% solution) |
| Part C | Bicarbonate Salt |

For this ternary foam kit, the highest possible concentration of Part A is limited to about 14% because the activated DF-100 foam solution has a much higher solids content than typical fire-fighting foam solutions, thereby limiting the total amount of water that is available for removal from the final, activated foam formulation, and because the solubility limits on the water-soluble polymer do not allow the removal of any additional water beyond this (already high) level of concentration. Also, removal of additional water may create a flammable solution.

An example of a procedure for making up an activated DF-100 foam solution in the field from a highly concentrated ternary foam kit, according to the present invention, is as follows. First, dilute the highly concentrated Part A concentrate by adding sufficient water until an intermediate concentration, about 30% to 92% of Part A is reached. Then, mix and completely dissolve an appropriate (possibly pre-measured) mass of Part C (e.g., potassium bicarbonate) into the now-diluted (e.g., 50%) aqueous solution of Part A, thereby yielding an intermediate bicarbonate concentration of about 8% (relative to the 50% diluted solution of Part A). Finally, add an appropriate amount of Part B (either as urea hydrogen peroxide powder, or as a dilute (≦8%) hydrogen peroxide solution) to achieve a final hydrogen peroxide concentration of 4% in the activated DF-100 foam solution.

An alternate procedure can be followed. First, nearly all of the water needed to makeup the activated DF-100 foam solution can be added to the highly concentrated (e.g., 14%) Part A in the field to bring its concentration up to nearly 100% (i.e., fully rehydrated). Next, Parts B and C can be added to the fully rehydrated Part A in powder foam. Care is needed, however, during mixing of Part B and/or Part C with the nearly 100% rehydrated Part A, because undesirable foaming of the solution can occur. Also, care must be taken not to premix powders of the bicarbonate salt (Part C) with powdered urea hydrogen peroxide (Part B) and store them together in a sealed container (e.g. bag or can) because they will react with each other and form gaseous products.

Binary Kit for Concentrated Non-foaming DF-100 Formulation

This description is identical to the description of a Binary Kit for Concentrated DF-100 Foam Formulation given above, except that the range of concentrations for Part A can be 23% to 92%, because water-soluble polymer additives are not used in these non-foaming formulations.

Ternary Kit for Highly Concentrated Non-foaming DF-100 Formulations

This description is identical to the description of a Ternary Kit for DF-100 Foam Formulations given above, except that the range of concentrations for Part A can be even more highly concentrated, from about 6% to 30%, because water-soluble polymer additives are not used in these non-foaming formulations.

Example 3 illustrates an example of a procedure for making up an activated DF-100 non-foaming solution in the field from a very highly concentrated ternary non-foaming kit, according to the present invention.

EXAMPLE 3

Procedure for Making Up Activated DF-100 Non-Foaming Solution from a Ternary Non-Foaming Kit 1. Mix 56.1 g of ADOGEN 477™ (3.5 wt. %) with 43.9 g of VARIQUAT 80MC™ (2.7 wt %). This will produce a non-aqueous 6.2% concentrate (Part A), having a concentration factor of 16×, relative to a total volume of final solution of 1.6 liter.
2. Add 64.5 g of potassium bicarbonate (Part C) to 707 g of water.
3. Then, add 100 g of the 6.2% concentrate (Part A) from Step 1 to the solution of potassium bicarbonate from Step 2. This makes a 50% concentration made up of Parts A+C.
4. Add 807 g of 8% hydrogen peroxide solution (Part B) to the 50% concentration of Parts A+C made in Step 2.

This procedure makes up a total volume of 1.6 liters of activated DF-100 non-foaming solution comprising: 3.5 wt % ADOGEN 477™ (cationic hydrotrope), 2.7 wt % VARIQUAT 80MC™ (cationic surfactant), 4 wt % potassium bicarbonate, 4 wt % hydrogen peroxide, and 85.8 wt % water.

EXAMPLE 3a

Procedure for Making Up Activated DF-100 Non-Foaming Solution from a Binary Non-Foaming Kit 1. Mix 65 g of potassium bicarbonate into 271 g of water until dissolved (this is at the lower limit of solubility for $KHCO_3$ in water).
2. Add 56 g of ADOGEN 477™ and 44 g of VARIQUAT 80MC™ to the $KHCO_3$ solution from step 1. This produces a 23% concentrate (Part A).
3. Add 371 g of the 23% concentrate (Part A) from step 2 to 1243 g of 5.2% hydrogen peroxide solution (Part B).

Method of Manufacturing the Concentrate for Part A for Binary/Ternary Kits

In general, it is necessary to mix the constituents of the formulations following specific, well-known chemical procedures, for example, in order to solubilize key ingredients such as the polymer and the fatty alcohols. Also, the pH can be adjusted throughout the procedures to facilitate solubilization of the polymer. Diethyleneglycol monobutylether, or a similar solvent (e.g., glycol ether or ether) can be used as a solvent for the fatty alcohol.

Examples of procedures for preparing a 14%, 25%, and 50% foam concentrate (Part A) for use in various DF-100 foam formulations, according to the present invention, is described in Examples 4, 5, and 6.

EXAMPLE 4

Preparation of a Highly Concentrated 14% Foam Concentrate (Part A) for a Ternary Kit for DF-100 Foam Solution #3

1. Mix deionized water (1440 g) and JAGUAR 8000™ polymer (38.6 g). The polymer should be added carefully, over an approximately 5–10 minute period, so clumps do not form. Polymer efficiency, therefore, final activated DF-100 solution viscosity, is enhanced by increased mechanical action during the mixing procedure. However, if the polymer is added too slowly, it will begin to gel at this ratio of polymer-to-water. Let the solution stir for 2 hours. Mixer settings and/or quantity of polymer added may need to be adjusted to produce a solution of optimal viscosity.
2. Mix WITCO ADOGEN 477™ (cationic hydrotrope) (1105.0 g) and Alcohol Mix #1 (576 g); then add to polymer solution made in step 1. Adjust pH to 6.5 by adding drops of 10% HCl. Cover and let stir >1 hour. Note: Alcohol Mix #1 contains 36.4% isobutanol, 56.4% diethylene glycol monobutyl ether (DEGMBE), and 7.3% dodecanol.
3. Add WITCO VARIQUAT 80MC™ (cationic surfactant) (2113.6 g) and stir >1 hour.
4. Add Fatty Alcohol Mix #3 (93.4 g). Cover and mix >1 hour. Note: Fatty Alcohol Mix #3 contains 37.5% DEGMBE, 47.5% 1-dodecanol, and 15% 1-tetradecanol.

The 14% foam concentrate (Part A) does not include hydrogen peroxide (Part B) or bicarbonate (Part C). It is envisioned that these components would be added immediately before use in the field. The order of preparation is generally determined by the different solubilities of the various components. Although steps 2, 3, and 4 can be performed in any order relative to each other in Example 4, step 1 should preferably be performed first.

EXAMPLE 5

Preparation of a Highly Concentrated 25% Foam Concentrate (Part A) for a Ternary Kit for DF-100 Foam Solution #1

1. Mix deionized water (280 g) and JAGUAR 8000™ polymer (2.6 g). The polymer should be added carefully, over an approximately 5–10 minute period, so clumps do not form. However, if the polymer is added too slowly, it will begin to gel at this ratio of polymer-to-water. Let the solution stir for 2 hours.
2. Mix WITCO ADOGEN 477™ (cationic hydrotrope) (76.8 g) and Alcohol Mix #1 (40.0 g); then add to polymer solution made in step 1. Adjust pH to 6.5 by addition of drops of 10% HCl. Cover and let stir >1 hour. Note: Alcohol Mix #1 contains 36.4% isobutanol, 56.4% diethylene glycol monobutyl ether (DEGMBE), and 7.3% dodecanol.
3. Add WITCO VARIQUAT 80MC™ (cationic surfactant) (60.0 g) and stir >½ hour.
4. Add Fatty Alcohol Mix #4 (93.4 g). Cover and mix >1 hour. Note: Fatty Alcohol Mix #4 contains 69% DEGMBE, 15% 1-dodecanol, 6% 1-tridecanol, and 10% 1-tetradecanol.

The 25% foam concentrate (Part A) does not include hydrogen peroxide (Part B) or bicarbonate (Part C). It is envisioned that these components would be added immediately before use in the field. The order of preparation is generally determined by the different solubilities of the various components. Although steps 2, 3, and 4 can be performed in any order relative to each other in Example 5, step 1 should preferably be performed first.

EXAMPLE 6

Preparation of a Concentrated 50% Foam Concentrate (Part A) for a Binary Kit for DF-100 Foam Solution #1

1. Mix deionized water (560 g) and potassium bicarbonate (69 g). Stir until completely dissolved.
2. Add JAGUAR 8000™ polymer (2.6 g) to solution of step 1. The polymer should be added carefully, over an approximately 5–10 minute period, so clumps do not form. However, if the polymer is added too slowly, it will begin to gel at this ratio of polymer-to-water. Let the solution stir for 2 hours.
3. Mix WITCO ADOGEN 477™ (cationic hydrotrope) (76.8 g) and Alcohol Mix #1 (40.0 g); add to polymer solution of step 2. Adjust pH to 6.5 by adding drops of 10% HCl. Cover and let stir >1 hour. Note: Alcohol Mix #1 contains 36.4% isobutanol, 56.4% diethylene glycol monobutyl ether (DEGMBE), and 7.3% dodecanol.
4. Add WITCO VARIQUAT 80MC™ (cationic surfactant) (60.0 g) and stir >1 hour.
5. Add the Fatty Alcohol Mix_#4 (93.4 g). Cover and mix >1 hour. Note: Fatty Alcohol Mix #4 contains 69% DEGMBE, 15% dodecanol, 6% 1-tridecanol, and 10% 1-tetradecanol.

The 50% foam concentrate (Part A) includes potassium bicarbonate, but does not include hydrogen peroxide (Part B). It is envisioned that Part B would be added immediately before use in the field. The order of preparation is generally determined by the different solubilities of the various components. Although steps 3, 4, and 5 can be performed in any order relative to each other in Example 6, step 1 should preferably be performed first, and then step 2 preferably performed second.

EXAMPLE 7

Preparation of a Highly Concentrated 6.2% Non-Foaming Concentrate (Part A) for Ternary Kit for DF-100 Non-Form Foam Solution #4

1. Mix 56.2 g of ADOGEN 477™ (3.5 wt. %) with 43.9 g of VARIQUAT 80MC™ (2.7 wt %). This will produce a non-aqueous 6.2% concentrate (Part A), with a concentration factor of 16×, relative to a total volume of final product of 1.6 liter.

EXAMPLE 8

Preparation of a Concentrated 23% Non-Foaming Concentrate (Part A) for Binary Kit for DF-100 Non-Foaming Solution #4

1. Mix 65 g of potassium bicarbonate into 271 g of water until dissolved (this is at the lower limit of solubility for $KHCO_3$ in water).
2. Add 56 g of ADOGEN 477™ and 44 g of VARIQUAT 80MC™. This produces a 23% concentrate (Part A).

Adjustment of pH of Activated DF-100 Solution for Optimum Neutralization

One issue about the using the activated DF-100 solution concerns the use by first responders vs. personnel involved in facility restoration. When used for facility restoration, the specific chemical or biological agent will be known. This allows the opportunity for the pH of the activated DF-100 solution to be adjusted to the optimum value for that specific agent or agents. This pH adjustment can be accomplished in a number of ways, for example, through the use of pre-measured packets in which a base (such as NaOH), is added to the solution immediately before use.

Activated DF-100 solution will function at pH values of approximately 5 to approximately 12. The optimum pH values for neutralization of various CW and BW agents using the formulation of the present invention are generally between approximately 8 and 11. However, for first responders, the specific agent will be, in general, unknown. Therefore an intermediate pH must be selected that will effectively react with all agents. This intermediate pH value will be, by necessity, a compromise. A suitable pH for first responder use was found to be approximately 9. This provides for less than optimal decontamination of all agents.

For optimal neutralization of Mustard and Anthrax spores, the pH can be adjusted to be about 8. For optimal neutralization of VX spores, the pH can be adjusted to be about 10 (for Formulation #1) and about 10.5 (for Formulation #3 or #4). For optimal neutralization of G agents, the pH can be adjusted to be anywhere between 8 and 10.

Neutralization of CBW agents can be achieved in a period of approximately 2–60 minutes depending on the agent.

Effectiveness of Neutralization

Studies have been performed with activated DF-100 solutions of the present invention to determine the effectiveness of neutralization of CW and BW agents. Details are contained in U.S. patent application Ser. No. 09/607,586, which is incorporated by reference.

Recently, an activated DF-100 solution has been tested against a non-pathogenic strain of *E. coli* and is very effective at disinfection (7-Log kill in 15 minutes).

Corrosion Inhibition

An additional compound can be added to the formulations of the present invention to aid in inhibiting corrosion of metal to which the formulation could be exposed. In one embodiment, dimethyl ethanolamine was added and inhibited corrosion of the steel substrate without detracting from the detoxification of CW simulants; the compound could have actually enhanced the chemical deactivation, since ethanolamine is known to catalyze the hydrolysis reaction of certain CW agents such as G-agents. The range for the addition of dimethyl ethanolamine is from 0.1 to 10%. Other potential corrosion inhibitor additives include triethanolamine, ethanolamine salts of C9, C10 and C12 diacid mixtures, dicyclohexyl amine nitrite, and N,N-dibenzylamine.

EXAMPLE 9

Field Demonstration Using Activated DF-100 Foam Solution

A field demonstration was conducted at the U.S. Army Dugway Proving Grounds, UT to determine the efficiency of activated DF-100 foam solution for killing bacterial spores deposited on common office materials. Six test panels (16"× 16") were set up and tested. The test panels consisted on ceiling tile, painted wallboard, carpet, painted metal, office partition, and concrete. The panels (except for concrete) were set up in a vertical position. The panels were sprayed with a suspension of Bacillus globigii spores, allowed to dry overnight, and sampled for their initial spore concentration. The areal coverage of solution sprayed onto each panel was approximately 100 ml per square meter of surface area. The foam formulation (at pH 8.0) was sprayed onto the surface of the test panels and left overnight. After approximately 20 hours, the test panels were sampled for surviving spores. The tests were repeated each day for four consecutive days.

Results for pre-test samples (i.e., contaminated) and post-test samples (i.e., decontaminated) for each day showed that high rates of spore kill (between a minimum of 4-Log kill and a maximum of 7-Log kill) were observed on all office materials that were tested.

From the foregoing description, one skilled in the art can easily ascertain the essential characteristics of the invention defined in this specification and the appended claims, and without departing from the spirit and scope thereof can make various changes and modifications of the invention to adapt it to various usages and conditions. Such changes and modifications as would be obvious to one skilled in the art are intended to be included within the scope of the following claims.

For example, saltwater may be substituted for water in any of the formulations described above. Neutralization performance is generally as effective as with pure water, however, the pH of the activated DF-100 solution may need to be adjusted when using saltwater (for example, adjusting the pH to 8 for neutralizing spores).

We claim:

1. An aqueous decontamination formulation for use in the neutralization of a chemical or biological toxant, comprising:

a cationic surfactant;

a cationic hydrotrope;

a reactive compound selected from the group consisting of nucleophilic compounds, oxidizing compounds, and combinations thereof;

a fatty alcohol having a concentration from greater than 1 wt. % to 2 wt %; and water.

2. The formulation of claim 1, wherein the reactive compound comprises a mixture of a bicarbonate salt and hydrogen peroxide.

3. The formulation of claim 2, wherein the bicarbonate salt is selected from the group consisting of potassium bicarbonate, sodium bicarbonate, ammonium bicarbonate, ammonium hydrogen bicarbonate, and lithium bicarbonate.

4. The formulation of claim 1, wherein the reactive compound comprises a 50/50 mixture of potassium bicarbonate and hydrogen peroxide.

5. The formulation of claim 1, further comprising:

a cationic water soluble polymer;

a short chain alcohol; and a glycol ether.

6. The formulation of claim 5, wherein:

the cationic surfactant comprises a mixture of benzyl (C12–C16) alkyldimethylammonium chlorides;

the cationic hydrotrope comprises pentamethyltallow alkyltrimethylenediammonium dichloride;

the cationic water-soluble polymer comprises Guar Gum, 2-hydroxypropyl ether;

the fatty alcohol comprises 1-dodecanol and 1-tetradecanol;

the short chain alcohol comprises isobutanol or isopropanol; and the glycol ether comprises diethylene glycol monobutyl ether.

7. The aqueous decontamination formulation of claim 5, wherein:

the cationic surfactant comprises a mixture of benzyl (C12–C16) alkyldimethylammonium chlorides;

the cationic hydrotrope comprises pentamethyltallow alkyltrimethylenediammonium dichloride; and the cationic water-soluble polymer comprises Guar Gum, 2-hydroxypropyl ether;

the fatty alcohol comprises a mixture of 1-dodecanol and 1-tetradecanol; and the short chain alcohol comprises a mixture of isobutanol and isopropanol.

8. The formulation of claim 1, wherein the cationic surfactant comprises a quaternary ammonium salt.

9. An aqueous decontamination formulation for use in the neutralization of a chemical or biological toxant, comprising:

a cationic surfactant;

a cationic hydrotrope;

a reactive compound selected from the group consisting of nucleophilic compounds, oxidizing compounds, and combinations thereof; and water; wherein the weight percentage ratio of surfactant to hydrotrope is from 0.5 to 3.5.

10. The formulation of claim 9, wherein the weight percentage ratio of surfactant to hydrotrope is about 3.

11. The formulation of claim 9, further comprising:

a cationic water-soluble polymer;

a short chain alcohol; and a glycol ether.

12. The formulation of claim 11, wherein the viscosity of the formulation has been adjusted to provide an optimum production of foam for a specific foam-generating nozzle through which the formulation is being sprayed.

13. The formulation of claim 12, wherein the viscosity has been adjusted by adjusting the amount of water-soluble polymer in the formulation.

14. A method for decontaminating a surface contaminated with a toxant, comprising applying the decontamination formulation of claim 11 the surface in to the form of a foam, and neutralizing the toxant, whereby the surface becomes decontaminated.

15. The method of claim 14, wherein the foam has a half-drainage time of greater than 2 hours.

16. The method of claim 14, wherein the foam has an expansion ratio from 60 to 120.

17. The method of claim 14, wherein the foam has an expansion ratio from 20 to 60.

18. The method of claim 14, wherein the foam is generated using a Venturi-type nozzle.

19. The method of claim 14, wherein the foam is generated using a source of compressed gas selected from the group consisting of air, nitrogen, and carbon dioxide.

20. The method of claim 14, wherein generating the foam comprises educting concentrated formulation from a container and mixing with a stream of water.

21. The formulation of claim 11, wherein the water-soluble polymer is guar gum.

22. The formulation of claim 11, wherein the formulation neutralizes at least one toxant selected from the group consisting of biological toxants and chemical toxants.

23. The formulation of claim 22, wherein the formulation neutralizes at least one toxant selected from the group consisting of o-alkyl phosphonofluoridates, sarin soman, tabun, VX and mustard compounds.

24. The formulation of claim 22, wherein the formulation neutralizes at least one toxant selected from the group consisting of bacterial spores, vegetative bacterial cells, and viruses.

25. The formulation of claim 22, wherein greater than 99.99% of *B. globigii* spores are killed within approximately one hour after exposure to the formulation.

26. The formulation of claim 25, wherein greater than 99.9999% of *B. globigii* spores are killed within approximately one hour after exposure to the formulation.

27. The formulation of claim 9, wherein the water comprises saltwater.

28. A method for decontaminating a surface contaminated with a toxant, comprising applying the decontamination formulation of claim 9 to the surface, and neutralizing the toxant, whereby the surface becomes decontaminated.

29. The method of claim 28, further comprising applying the formulation as a liquid to the contaminated surface using a method selected from the group consisting of spraying, fogging, misting, exposing to aerosols, wiping with a wet cloth, drenching, immersing, showering, spraying in a curtain spray, pouring, dripping and bathing in the liquid.

30. The method of claim 29, wherein spraying is performed using a hand-held spray bottle or a backpack-mounted spray apparatus.

31. The method of claim 29, further comprising using a remotely-controlled fogging device inside of a structure.

32. The method of claim 28, further comprising mixing together all of the components of a multi-part kit system immediately prior to application.

33. The method of claim 32, wherein mixing together all of the components comprises using an eductor apparatus to induct one or more of the components into one or more streams of moving water.

34. The method of claim 32, further comprising mixing together a two-part binary system, comprising adding a sufficient amount of water to a packet containing urea hydrogen peroxide to make up a solution of hydrogen peroxide, and then applying the solution of hydrogen peroxide to a premoistened towlette comprising all of the other constituents of the decontamination formulation except for hydrogen peroxide to activate the towlette.

35. The method of claim 28, further comprising applying the formulation in the form of a semi-solid selected from the group consisting of a gel, a lotion, a cream, and a paste.

36. The method of claim 28, further comprising applying the formulation to a surface inside of an industrial setting selected from the group consisting of a food processing plant, a hospital, an agricultural facility, an institutional building, an ambulance, and a cooking area.

37. The method of claim 28, further comprising introducing a fog of the formulation into air ducts inside of a building.

38. The method of claim 28, further comprising spraying the formulation from an airplane.

39. The formulation of claim 9, wherein the cationic surfactant comprises a quaternary ammonium salt.

40. The formulation of claim 39, wherein the quaternary ammonium salt is selected from the group consisting of cetylpyridinium chloride, tetrabutyl ammonium bromide and polymeric quaternary compounds.

41. The formulation of claim 9, further comprising a corrosion inhibitor selected from the group consisting of dimethyl ethanolamine, triethanolamine, ethanolamine salts of C9, C10 and C12 diacid mixtures, dicyclohexyl amine nitrite, and N,N-dibenzylamine.

42. An aqueous decontamination formulation for use in the neutralization of a chemical or biological toxant, comprising:

4–6 wt % of a cationic surfactant;

1–3 wt % of a cationic hydrotrope;

0.5–2 wt % of a fatty alcohol;

0.05–0.1 wt % of a cationic water soluble polymer;

0.5–1.5 wt % of a short chain alcohol;

1–2 wt % of a glycol ether compound;

4 wt % of a bicarbonate salt;

4 wt % of a hydrogen peroxide; and water.

43. The formulation of clam 42, comprising:

about 4.2 wt % a mixture of benzyl (C12–C16) alkyldimethylammonium chlorides;

about 1.4 wt % pentamethyltallow alkyltrimethylenediammonium dichloride;

about 0.07 wt % Guar Gum, 2-hydroxypropyl ether;

about 1.3 wt % 1-Dodecanol;

about 0.5 wt % 1-Tetradecanol;

about 0.4 wt % Isobutanol;

about 0.8 wt % Isopropanol;

about 1.5 wt % Diethylene Glycol Monobutyl Ether;

about 4.0 wt % Potassium Bicarbonate;

about 4.0 wt % Hydrogen Peroxide; and water.

44. The formulation of claim 42, comprising:

about 5.3 wt% a mixture of benzyl (C12–C16) alkyldimethylammonium chlorides;

about 2.8 wt% pentamethyltallow alkyltrimethylenediammonium dichloride;

about 0.1 wt% Guar Gum, 2-hydroxypropyl ether;

about 0.7 wt% 1-Dodecanol;

about 0.5 wt% Isobutanol;

about 1.4 wt% Diethylene Glycol Monobutyl Ether;

about 4.0 wt% Potassium Bicarbonate;

about 4.0 wt% Hydrogen Peroxide; and water.

45. The formulation of claim 44, wherein the pH of the formulation is about 8; whereby the neutralization of Mustard and Anthrax spores is optimum.

46. The formulation of claim 44, wherein the pH of the formulation is about 10, whereby the neutralization of VX is optimum.

47. The formulation of claim 44, wherein the pH of the formulation is in-between 8 and 10, whereby the neutralization of G agents is effective in this range.

48. The formulation of claim 44, wherein the pH of the formulation is about 9.2, whereby the neutralization of all agents is less than optimum.

49. The formulation of claim 42, wherein the cationic surfactant comprises a quaternary ammonium salt.

50. An aqueous decontamination formulation for use in the neutralization of a chemical or biological toxant, comprising:

about 2.6 wt % of a cationic surfactant;

about 3.3 wt % of a cationic hydrotrope;

about 0.8 wt % of a fatty alcohol;

about 0.1 wt % of a cationic water soluble polymer;

about 2.1 wt % of a short chain alcohol;

about 1.6 wt % of a glycol ether compound;

about 4 wt % of a bicarbonate salt;

about 4 wt % of hydrogen peroxide; and water.

51. The formulation of claim 50, wherein the pH of the formulation is about 8; whereby the neutralization of Mustard and Anthrax spores is optimum.

52. The formulation of claim 50, wherein the pH of the formulation is about 10.5, whereby the neutralization of VX is optimum.

53. The formulation of claim 50, wherein the pH of the formulation is in-between 8 and 10, whereby the neutralization of G agents is effective in this range.

54. The formulation of claim 50, wherein the cationic surfactant comprises a quaternary ammonium salt.

55. An aqueous, non-foaming decontamination formulation for use in the neutralization of a chemical or biological toxant, comprising:

0.1–10 wt% of a cationic surfactant;

0.1–10 wt % of a cationic hydrotrope;

0.1–10 wt % of a bicarbonate salt;

0.1–10% of hydrogen peroxide; and water.

56. The formulation of claim 55, comprising:

about 2.7 wt% of a cationic surfactant;

about 3.5 wt % of a cationic hydrotrope;

about 4 wt % of a bicarbonate salt;

about 4% of hydrogen peroxide; and water.

57. The formulation of claim 55, wherein the cationic surfactant comprises a quaternary ammonium salt.

58. A binary kit system consisting of two components that, when mixed together, makes an aqueous decontamination formulation for use in the neutralization of a chemical or biological toxant, the system comprising:

a first premixed component, Part A, comprising an aqueous mixture of a cationic surfactant, a cationic hydrotrope, and a bicarbonate salt, wherein Part A has a concentration of 30–92 wt%; and a second component, Part B, comprising hydrogen peroxide.

59. The binary kit system of claim 58, wherein the Parts A and B contain all of the water needed to make up the final formulation.

60. The binary kit system of claim 58, wherein the Parts A and B do not contain all of the water needed to make up the final formulation.

61. The binary kit system of claim 58, wherein the concentration of Part A is about 50 wt%.

62. The binary kit system of claim 58, wherein the concentration of hydrogen peroxide in Part B is about 8 wt%.

63. The binary kit system of claim 62, wherein Part A comprises:

about 5.3 wt% a mixture of benzyl (C12–C16) alkyldimethylammonium chlorides;

about 2.8 wt% pentamethyltallow alkyltrimethylenediammonium dichloride;

about 0.1 wt% Guar Gum, 2-hydroxypropyl ether;

about 0.7 wt% 1-Dodecanol;

about 0.5 wt% Isobutanol;

about 1.4 wt% Diethylene Glycol Monobutyl Ether; and about 4.0 wt% Potassium Bicarbonate.

64. The binary kit system of claim 58, wherein the concentration of hydrogen peroxide in Part B is less than or equal to 8 wt%.

65. The binary kit system of claim 58, wherein Part B comprises a pre-measured amount of a water-soluble solid form of hydrogen peroxide, that, when mixed with a sufficient amount of water, forms a solution of hydrogen peroxide having a concentration less than or equal to 34 wt%.

66. The binary kit system of claim 65, wherein the solution of hydrogen peroxide has a concentration less than or equal to 8 wt%.

67. The binary kit system of claim 65, where the water-soluble solid form of hydrogen peroxide is selected from the group consisting of urea hydrogen peroxide, sodium perborate, and sodium percarbonate.

68. A method of making up an aqueous decontamination formulation for use in the neutralization of a chemical or biological toxant, comprising mixing together Part A and Part B from the binary kit system of claim 58 with a sufficient amount of water.

69. The method of claim 68, wherein the concentration of Part A is about 50 wt%, and the concentration of hydrogen peroxide in Part B is about 8 wt%.

70. The method of claim 69, further comprising mixing together substantially equal volumes of Part A and Part B.

71. The method of claim 68, further comprising, prior to mixing Part A and Part B, making up Part B by dissolving a pre-measured amount of a water-soluble solid form of hydrogen peroxide in a sufficient amount of water.

72. The method of claim 71, wherein the water-soluble solid form of hydrogen peroxide comprises urea hydrogen peroxide.

73. The method of claim 68, further comprising, prior to mixing Part A and Part B, making up Part B by diluting a highly concentrated solution of hydrogen peroxide to produce a less concentrated solution of hydrogen peroxide.

74. The method of claim 73, wherein the highly concentrated solution comprises 30–50 wt% concentration, and the less concentrated solution comprises less than or equal to 8 wt% concentration.

75. The method of claim 68, wherein the aqueous decontamination formulation made after mixing Parts A and B has a final hydrogen peroxide concentration of about 4 wt%.

76. The binary kit system of claim 58, wherein Part A further comprises:

a short chain alcohol;

a fatty alcohol; and a glycol ether.

77. The system of claim 58, wherein the cationic surfactant comprises a quaternary ammonium salt.

78. A ternary kit system consisting of three components that, when mixed together, makes an aqueous decontamination formulation for use in the neutralization of a chemical or biological toxant, the system comprising:

a first premixed component, Part A, comprising an aqueous mixture of a cationic surfactant, and a cationic hydrotrope, wherein Part A has a concentration of 14–30 wt%;

a second component, Part B, comprising hydrogen peroxide; and a third component, Part C, comprising a bicarbonate salt.

79. The ternary kit system of claim 78, wherein the Parts A, B, and C contain all of the water needed to make up the final formulation.

80. The ternary kit system of claim 78, wherein the Parts A, B, and C do not contain all of the water needed to make up the final formulation.

81. The ternary kit system of claim 78, wherein the concentration of hydrogen peroxide in Part B is less than or equal to 50 wt%.

82. The ternary kit system of claim 81, wherein the concentration of hydrogen peroxide in Part B is less than or equal to 8 wt%.

83. The ternary kit system of claim 78, wherein Part B comprises a pre-measured amount of a water-soluble solid form of hydrogen peroxide.

84. The ternary kit system of claim 78, wherein the water-soluble solid form of hydrogen peroxide is selected from the group consisting of urea hydrogen peroxide, sodium perborate, and sodium percarbonate.

85. A method of making up an aqueous decontamination formulation for use in the neutralization of a chemical or biological toxant, comprising mixing together Parts A, B, and C from the ternary kit system of claim 78 with a sufficient amount of water.

86. The method of claim 85, further comprising, in the order presented:

a) diluting Part A by adding a sufficient amount of water until an intermediate concentration is reached where Part C is able to be dissolved into the diluted Part A;

b) dissolving Part C into the solution created in step a); and c) mixing Part B with the solution created in step b).

87. The method of claim 86, wherein Part A is diluted to an intermediate concentration of about 50 wt% in step a); and further wherein Part B has a hydrogen peroxide concentration less than or equal to 8 wt%.

88. The method of claim 86, wherein Part C is completely dissolved in a sufficient amount of water, and then Parts A and B are added.

89. The method of claim 85, wherein the aqueous decontamination formulation made after mixing Parts A, B, and C has a final hydrogen peroxide concentration of about 4 wt%.

90. The method of claim 85, further comprising, in the order presented:

a) diluting Part A by adding a sufficient amount of water until a nearly 100 wt % concentration is reached; and b) dissolving Parts B and C into the solution created in step a), wherein Parts B and C are in solid form.

91. The ternary kit system of claim 78, wherein Part A further comprises:

a short chain alcohol;

a fatty alcohol; and a glycol ether.

92. The system of claim 78, wherein the cationic surfactant comprises a quaternary ammonium salt.

93. A ternary kit system consisting of three components that, when mixed together, makes an aqueous non-foaming decontamination formulation for use in the neutralization of a chemical or biological toxant, the system comprising:

a first premixed component, Part A, comprising an aqueous mixture of a cationic surfactant and a cationic hydrotrope, with no amount of cationic water-soluble polymer, wherein Part A has a concentration of 6–30 wt%;

a second component, Part B, comprising hydrogen peroxide; and a third component, Part C, comprising a bicarbonate salt.

94. The ternary kit system of claim 93, wherein the Parts A, B, and C contain all of the water needed to make up the final formulation.

95. The ternary kit system of claim 93, wherein the Parts A, B, and C do not contain all of the water needed to make up the final formulation.

96. The system of claim 93, wherein the cationic surfactant comprises a quaternary ammonium salt.

97. A binary kit system consisting of two components that, when mixed together, makes an aqueous non-foaming decontamination formulation for use in the neutralization of a chemical or biological toxant, the system comprising:

a first premixed component, Part A, comprising an aqueous mixture of a cationic surfactant, a cationic hydrotrope, and bicarbonate salt, with no amount of cationic water-soluble polymer, wherein Part A has a concentration of 23–30 wt%; and a second component, Part B, comprising hydrogen peroxide.

98. The system of claim 68, wherein the cationic surfactant comprises a quaternary ammonium salt.

99. A method of manufacturing a premixed concentrate 30–50 wt% for use as Part A of a binary kit system, for use in making up a decontamination formulation for use in the neutralization of a chemical or biological toxants; comprising mixing together at least the following constituents:

0.1–10 wt% of a cationic surfactant;

0.1–10 wt% of a cationic hydrotrope;

0.05–10 wt% of a water-soluble polymer;

0.1–10 wt% of a bicarbonate salt; and a sufficient amount of water.

100. The method of claim 99, further comprising adding the water-soluble polymer to water at a rate slow enough to prevent clumps from forming, but fast enough to prevent the solution from gelling, and then stirring to completely dissolve.

101. The method of claim 99, further comprising, as a first step, dissolving the bicarbonate salt in an appropriate amount of water.

102. The method of claim 99, further comprising:

a) mixing the bicarbonate salt with water;

b) adding the polymer to the solution of step a) at a rate slow enough to prevent clumps from forming, but fast enough to prevent the solution from gelling, and then stirring to completely dissolve;

c) mixing the cationic hydrotrope with a first alcohol mix, and then adding to the polymer solution of step b);

d) adjusting the pH to about 6.5 of the solution of step c) and stirring;

e) adding the cationic surfactant and stirring; and f) adding a fatty alcohol mix and stirring.

103. The method of claim 102, wherein the first alcohol mix contains 36.4% isobutanol, 56.4% diethylene glycol monobutyl ether (DEGMBE), and 7.3% dodecanol.

104. The method of claim 102, wherein the fatty alcohol mix contains 69% DEGMBE, 15% dodecanol, 6% 1-tridecanol, and 10% 1-tetradecanol.

105. The method of claim 99, wherein the cationic surfactant comprises a quaternary ammonium salt.

106. A method of manufacturing a premixed concentrate of 14–30 wt% for use as Part A of a ternary kit system, for use in making up a decontamination formulation for use in the neutralization of a chemical or biological toxants; comprising mixing together at least the following constituents:

0.1–10 wt% of a cationic surfactant;

0.1–10 wt% of a cationic hydrotrope;

0.05–10 wt% of a water-soluble polymer; and a sufficient amount of water.

107. The method of claim 106, further comprising adding the water-soluble polymer to water at a rate slow enough to prevent clumps from forming, but fast enough to prevent the solution from gelling, and then stirring to completely dissolve.

108. The method of claim 106, further comprising:

a) adding the polymer to the water at a rate slow enough to prevent clumps from forming, but fast enough to prevent the solution from gelling, and then stirring to completely dissolve;

b) mixing the cationic hydrotrope with a first alcohol mix, and then adding to the polymer solution of step a);

c) adjusting the pH to about 6.5 of the solution of step c) and stirring;

d) adding the cationic surfactant and stirring; and e) adding a fatty alcohol mix and stirring.

109. The method of claim 108, wherein the first alcohol mix contains 36.4% isobutanol, 56.4% diethylene glycol monobutyl ether (DEGMBE), and 7.3% dodecanol.

110. The method of claim 109, wherein the fatty alcohol mix contains 69% DEGMBE, 15% dodecanol, 6% 1-tridecanol, and 10% 1-tetradecanol.

111. The method of claim 106, wherein the cationic surfactant comprises a quaternary ammonium salt.

* * * * *